US005950960A

United States Patent [19]

Marino

[11] Patent Number: 5,950,960

[45] Date of Patent: Sep. 14, 1999

[54] DISPENSER FOR MOIST TISSUE AND DRY TISSUE

[75] Inventor: John J. Marino, Winchester, Mass.

[73] Assignee: NUWAY Corporation, Boston, Mass.

[21] Appl. No.: 09/021,917

[22] Filed: Feb. 11, 1998

[51] Int. Cl.[6] ..... B65H 16/02; B65H 18/02

[52] U.S. Cl. ..... 242/594.5; 242/594.1

[58] Field of Search ..... 242/594.1, 594.2, 242/594.3, 594.5, 595; 312/34.22; D6/520

[56] References Cited

U.S. PATENT DOCUMENTS 5,765,717 6/1998 Gottselig ..... 242/595

*Primary Examiner*—John Q. Nguyen

*Attorney, Agent, or Firm*—Paul J. Cook

[57] ABSTRACT

A dispenser construction including a housing section for moist tissue and a housing section for dry tissue is provided. The housing sections are joined together and are spaced apart from each other to form a slot through which a conventional spindle support for toilet tissue can be passed. The spindle supports the dispenser construction. Alternatively, the housing sections can be joined together by a section of sections which includes a hole sized to accommodate a spindle support.

13 Claims, 10 Drawing Sheets

DISPENSER FOR MOIST TISSUE AND DRY TISSUE

BACKGROUND OF THE INVENTION

This invention relates to a dispenser of moist tissue and for dry tissue. More particularly, the present invention relates to a dispenser for dry tissue and for moist tissue which effectively seals moist tissue housed within the dispenser to maintain its moisture content and which includes means of hanging the dispenser from a conventional toilet tissue holder which includes a spindle.

Pre-moistened tissues are formed from a highly absorbent sheet material such as tissue paper or tissue paper which may contain polymeric fibers that provide strength to the tissue paper and which are moistened with a liquid cleaning agent. The cleaning agent may also contain a medicament, deodorant or the like. Since the tissue is moist, in must be stored in a container which seals the tissue from the atmosphere surrounding the dispenser in order to prevent the liquid from evaporating from the tissue. In addition, the dispenser must permit ease of access to moist tissue for the user so that it can be easily dispensed in the desired amount by the user. The requirements for sealing and ease of access present conflicting criteria since the ease of access requirement also requires that at least a portion of the moist tissue be readily accessible to the user without opening the dispenser. Thus, the exposed tissue provides a means for allowing evaporation from the moist tissue stored in the dispenser which evaporation is to be minimized.

It is also desirable that the dispenser can be conveniently stored in the area of use which is primarily the bathroom portion of the living area. In addition, it is desirable that the dispenser be reusable so that, after all of moist tissue has been used, the dispenser can be opened to insert a new supply of moist tissue or moist tissue and dry tissue, thereby eliminating the need to purchasing a dispenser with each new source of moist and/or dry tissue. Thus, the dispenser must be capable of being sealed after a new supply of moist tissue has been added to the dispenser. Since the moist tissue normally is used in the bathroom, it would be desirable provide a means of storing the dispenser which cooperates with conventional bathroom fixtures such as the spindle conventionally used to support a roll of dry toilet paper wound about a hollow core. In addition, there exists significant user preference for both dry tissue and for moist tissue.

Accordingly, it would be desirable to provide a dispenser for moist tissue or moist tissue and dry tissue stored therein which permits dispensing a desirable length of tissue while sealing the stored moist tissue from the atmosphere, thereby preventing undesirable tissue drying. In addition it would be desirable to provide such a dispenser which permits dispensing moist or dry tissue without opening the dispenser. In addition, it would be desirable to provide such a dispenser which can be secured to existing conventional storing means for dry toilet tissue. Furthermore, it would be desirable to provide such a dispenser which also can be utilized to dispense dry tissue so that satisfactory use can be attained from users who prefer dry tissue and users who prefer moist tissue.

SUMMARY OF THE INVENTION

This invention provides a dispenser construction for moist tissue and for dry tissue. A first housing section for a roll of dry tissue is joined to a second housing section for a roll of moist tissue. The two housing sections are configured so that they can be supported by a single spindle conventionally used to support a roll of toilet tissue. In one embodiment, the dispenser is provided with a through hole into which a conventional spring-loaded spindle is positioned. In a second embodiment, the two housing sections are joined together but with a substantial portion of their length and width being spaced from each other to form a space into which is positioned a support for the dispenser construction such as a conventional spindle construction currently used to support a conventional roll of tissue. In this second embodiment, the dispenser can be slideably mounted onto a spindle positioned on a conventional toilet tissue roll support. The housing section for the moist tissue has a cover which seals the interior of the housing section from the surrounding atmosphere and which includes a slot for dispensing the tissue from the housing section. The housing section for the dry tissue also can have a cover or it can be free of the cover.

When the dispenser construction of this invention is positioned on a support spindle, a back surface of the housing sections contact a vertical surface such as a wall surface. This contact permits dispensing moist or dry tissue from a roll of tissue while preventing rotation of housing sections.

DESCRIPTION OF SPECIFIC EMBODIMENTS

Figure 1:
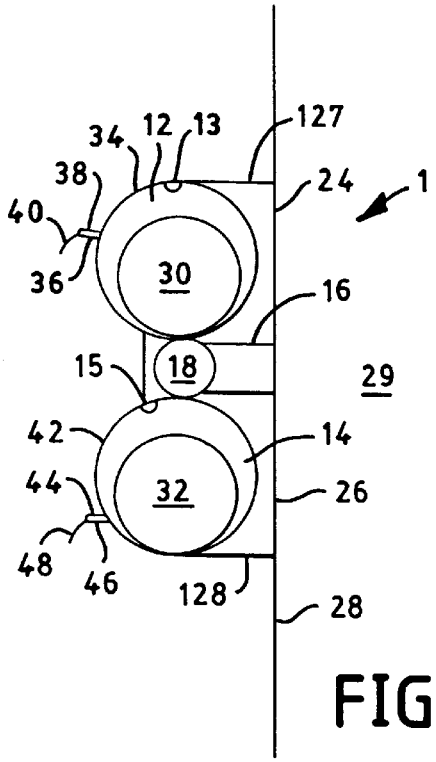
FIG. 1 is a side view of a dispenser construction of this invention in position for use.

The dispenser construction of this invention is capable of being stored on a conventional spindle presently used to support a roll of tissue paper. The dispenser construction of this invention is formed from two housing sections, one of which houses a roll of moist tissue and one of which can house a roll of dry tissue or a roll of moist tissue. In one embodiment of this invention, the housing sections are connected but also are spaced apart from each other to form a space through which the supporting spindle for the dispenser construction can be passed from a back surface of the dispenser construction toward a front surface of the dispenser construction. The dispenser is directed along a path defined by the space toward the supporting spindle until a surface of each of the housing sections contacts a support surface such as a wall surface. When the dispenser construction of this invention is so-positioned, the spindle is capable of supporting the dispenser construction in a stable position and tissue then can be dispensed from either housing section without causing rotation of the dispenser construction. Undesirable rotation is prevented by virtue of the contact of the housing sections with the support surface. Each housing section for the moist tissue includes a movable cover which, when open, permits addition of moist tissue to the housing section. When the cover is closed, a seal is effected between the interior of the housing section and the surrounding atmosphere so that the moist tissue does not become dried by virtue of liquid evaporation therefrom. The cover forms a slot with the housing section so that moist tissue can be dispensed therefrom by the user. A second housing section for the dry tissue can be open to the atmosphere or can include a cover similar to that employed for the housing section roll which houses moist tissue so that the second housing section can be used to store and dispense moist tissue or dry tissue.

In a second embodiment, the two housing sections are joined together along a substantial portion of the length of the two housing sections. A space extending through the entire width of the portion of the dispenser which joins the two housing sections is provided. The space is sized and shaped to accommodate a spindle used in conjunction with a conventional support structure for a roll of toilet issue. As in the embodiment set forth above, each housing section for moist tissue is provided with a seal to prevent substantial liquid evaporation from the moist tissue. In addition, as in the embodiment set forth above, a surface of the housing sections contacts a support surface such as a wall to prevent their rotation during use. At least one housing section is configured to house a roll of moist tissue which prevents substantial evaporation of moisture from the roll. A second housing section also can be configured to house a roll of moist tissue to provide a seal against moisture evaporation. The second housing section also can be configured to house a roll of dry tissue without the need for a cover which effects sealing of the interior of the second housing section from the surrounding atmosphere.

Figure 2:
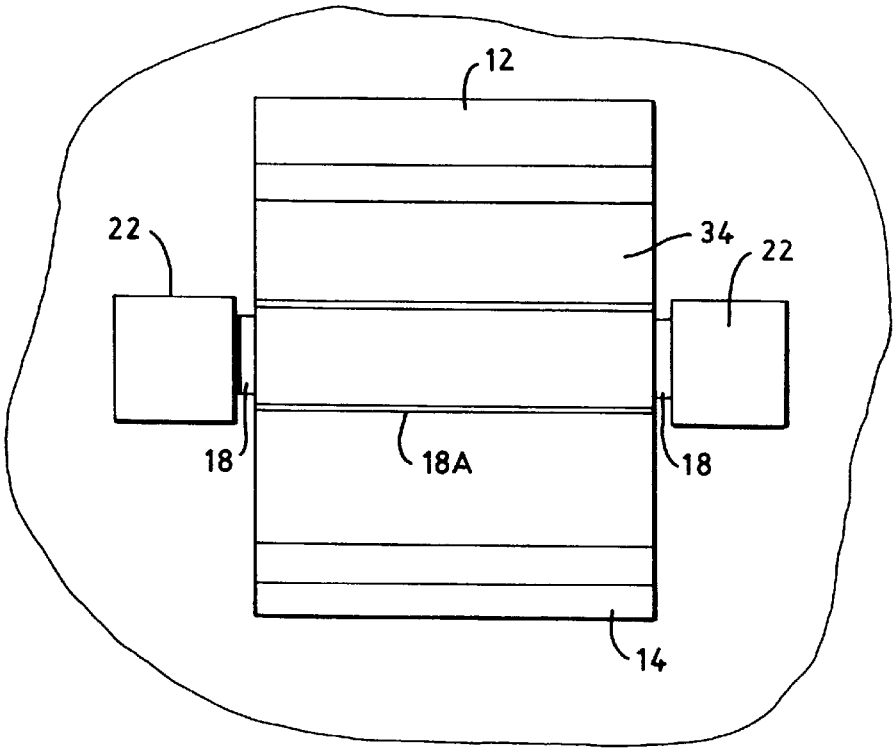
FIG. 2 is a front view of the dispenser construction of FIG. 1.

Referring to FIGS. 1 and 2, housing construction 10 comprises a first housing section 12 and a second section 14. The housing sections 12 and 14 are spaced apart from each other to form a slot-like space 16. The space 16 permits the dispenser construction 10 to be positioned on a conventional spindle 18 which is positioned in a conventional support for a roll of tissue and includes conventional arms 22. The arms are secured to a vertical wall 29 such as with an adhesive. Housing section 12 includes back surface 24 and housing section 14 includes a back surface 26. The back surfaces 24 and 26 contact support surface 28 of wall 29. Because of the contact between both surfaces 24 and 26 with support surface 28, rotation of the dispenser construction 10 is prevented when the tissue is dispensed from a housing section 12 or housing section 14. Housing section 12 houses a roll of moist tissue 30 and housing section 14 houses a roll of dry tissue or moist tissue. Housing section 12 includes a cover 34 having a flange 36 which cooperates with flange 38 of housing section 12 to form a slot through which moist tissue is dispensed. Cover 34 is supported on hinge 13 so that it can be opened or closed. The housing section 14 includes a cover 42 having a flange 44 which cooperates with flange 46 to form a slot through which dry tissue 48 is dispensed. Cover 42 is supported on hinge 15 so that it can be opened or closed.

Figure 3:
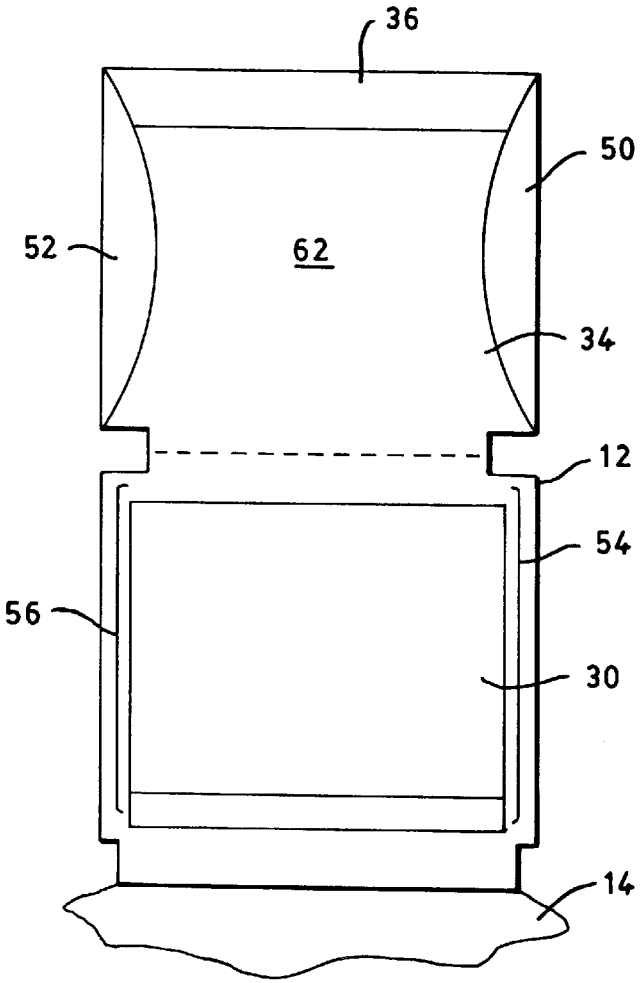
FIG. 3 is a side, cross sectional, partial view of the dispenser for construction of FIG. 1.
Figure 4:
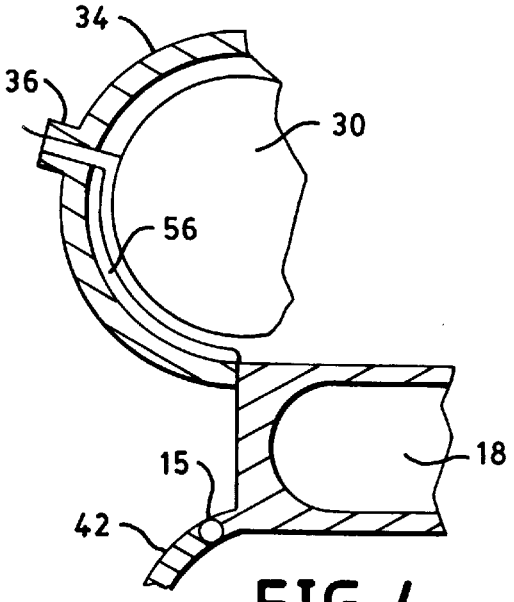
FIG. 4 is a partial front view of the cover construction for the housing section for moist tissue of the dispenser construction of FIG. 1.

Referring to FIGS. 3 and 4, a sealing arrangement for the cover of the dispenser construction of this invention is shown. The cover 34 includes side walls 52 and 54 positioned on opposite surfaces of cover 34. The walls 50 and 52 cooperate with extensions 54 and 56 which are positioned interior of walls 50 and 52 when cover 34 is closed. The walls 50 and 52 and extensions 54 and 56 function to seal the interior 62 of the housing section 12 from the surrounding atmosphere. Similarly, if desired, housing section 14 having a cover 42 also can have its periphery shaped in the same manner as described above with reference to cover 34. While a sealing arrangement is not required for dry tissue, sealing covers for both housing sections 12 and 14 permit the user to place a roll of moist tissue in either or both housing sections 12 and/or 14. When dry tissue is stored in housing section 14, cover 42 need not be utilized.

Figure 5:
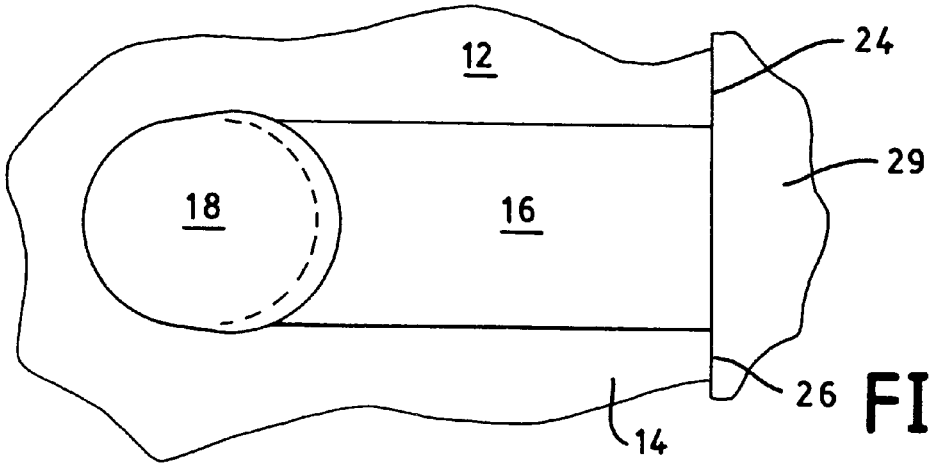
FIG. 5 is a partial cross sectional view of a space in a dispenser construction of this invention for positioning a supporting spindle for the dispenser construction of this invention.
Figure 6:
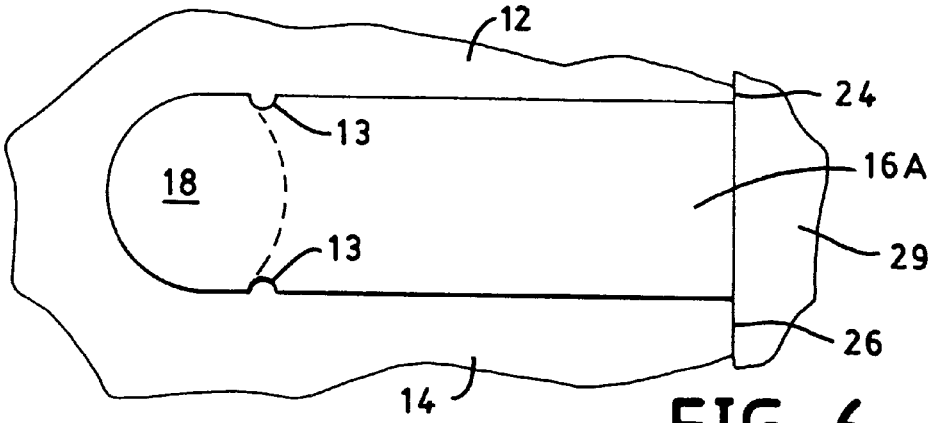
FIG.6 illustrates an alternative space for a supporting spindle for the dispenser construction of this invention.
Figure 7:
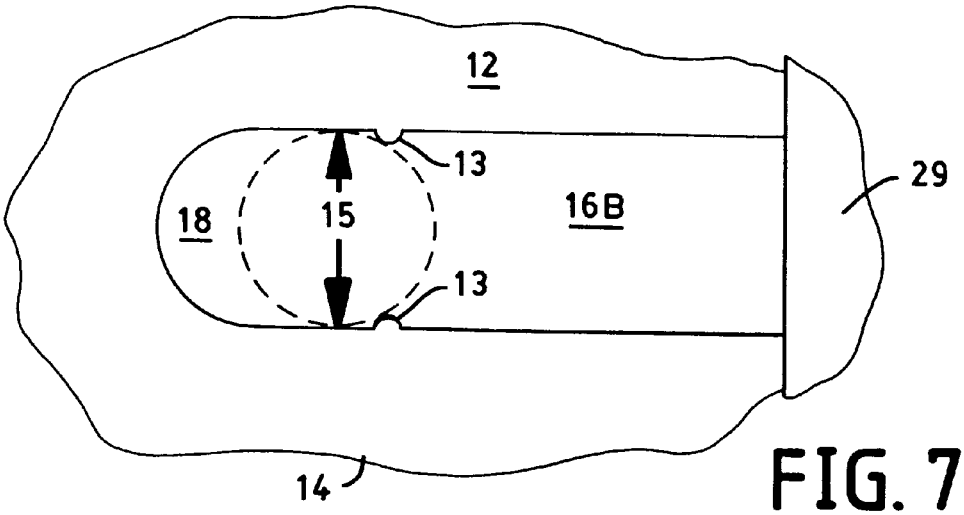
FIG. 7 illustrates an alternative space for a supporting spindle for the dispenser construction of this invention.

Referring to FIGS. 5, 6 and 7, the space between housing sections 12 and 14 is shaped so that a spindle 18 preferably is positioned at the innermost portion of the interior of space 16 while back surfaces 24 and 26 of housing sections 12 and 14 contact wall 29. An alternative space 16A between housing sections 12 and 14 is shown in FIG. 6. The surface defining space 16A includes a lip 13 which extend about this circumference of space 16A so that the spindle 18 can be snap fit and retained by lip 13 in the position shown in FIG. 6.

Referring to the embodiment shown in FIG. 7, the surface defining the space 16B positioned between housing sections 12 and 14 is slightly longer than the distance between spindle 18 and wall 29. The lip 13 which extends about the circumference of space 16B serves to retain spindle 18 in a position shown since the lip 13 is positioned past the midline 15 of spindle 18.

Figure 8:
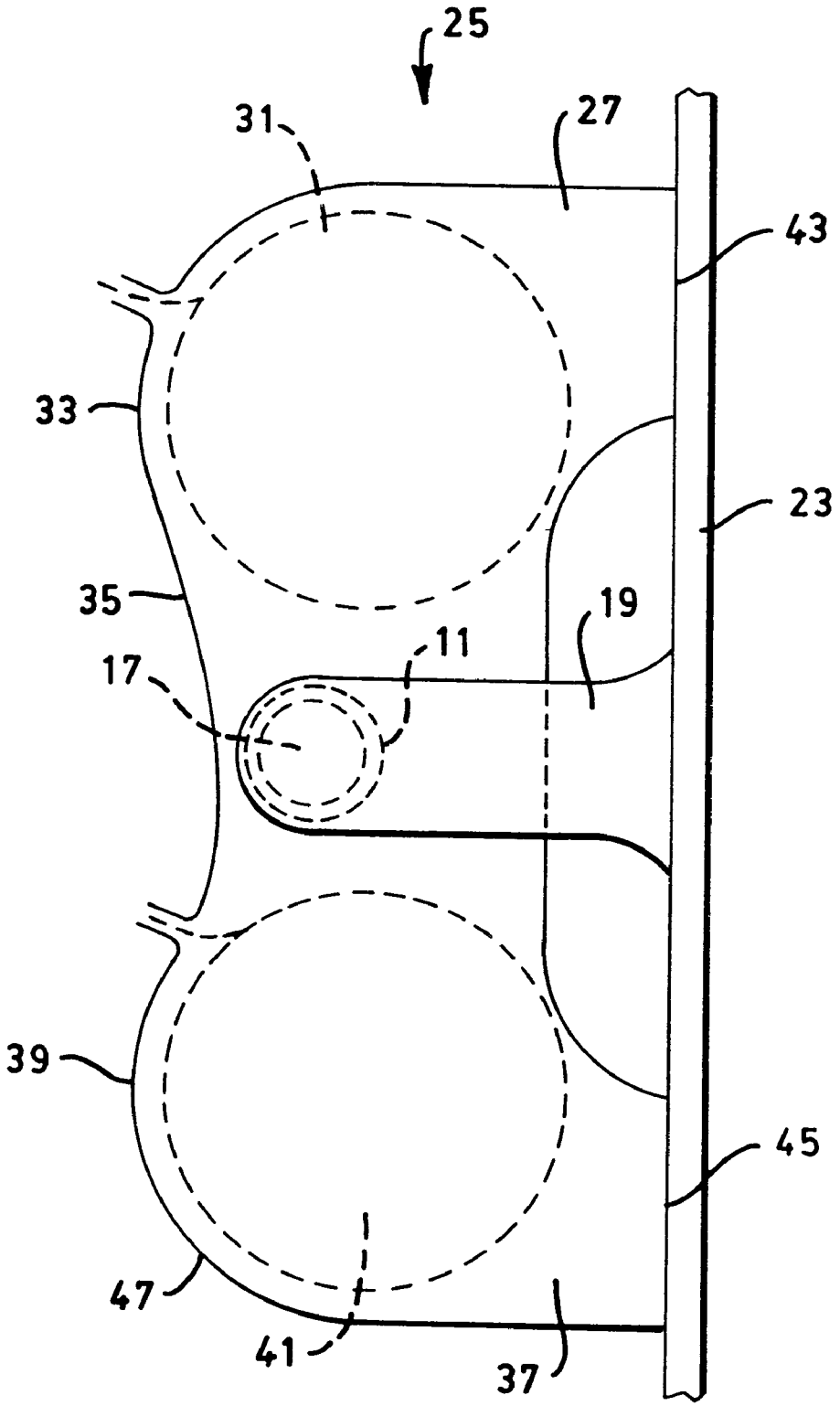
FIG. 8 is a side view of an alternative dispenser embodiment of this invention.
Figure 9:
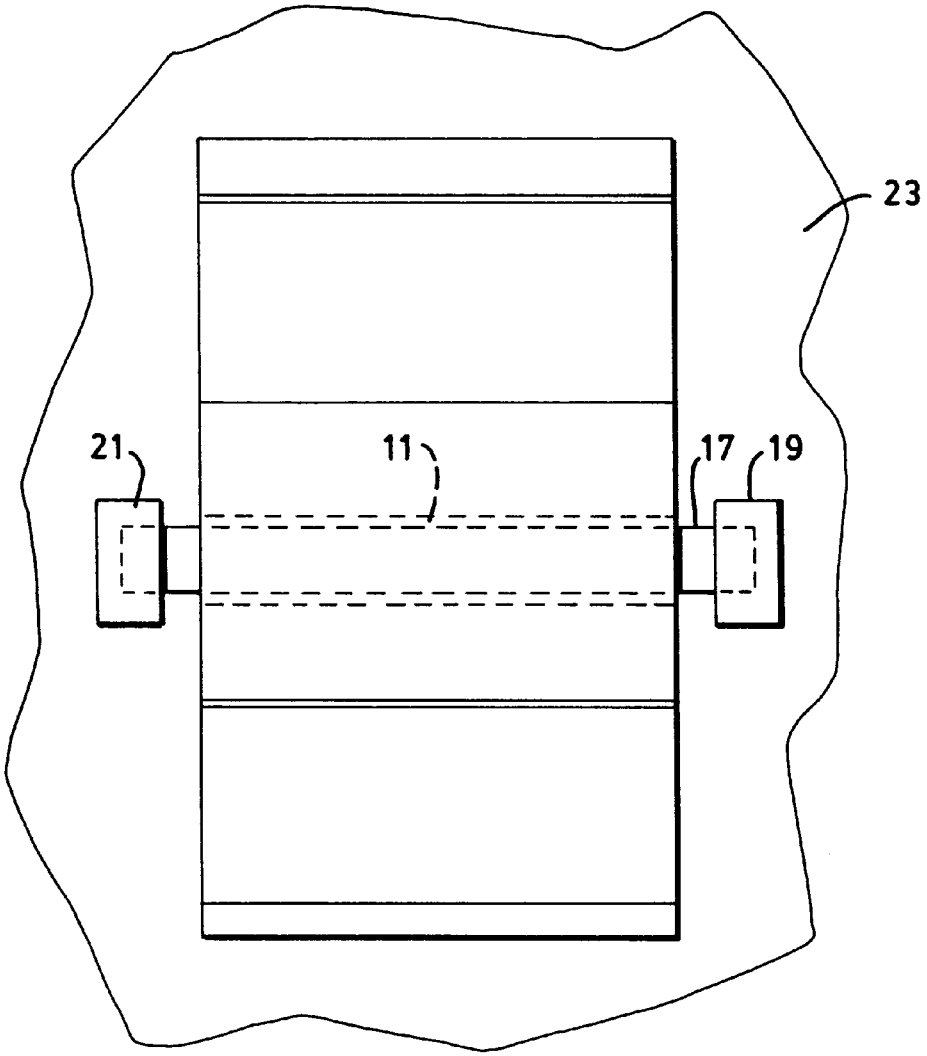
FIG. 9 is a front view of the dispenser embodiment of FIG. 8.

Referring to FIGS. 8 and 9, a dispenser embodiment 25 of this invention is shown in which a supporting spindle is inserted through a space 11 sized and shaped to accommodate the spindle. A spindle 17 is positioned on two arms 19 and 21 which, in turn, are attached to wall 23. The dispenser 25 includes a top section 27 which houses a roll of moist tissue 31. A cover 33 attached to hinge 35 can be opened to insert the roll 31 into the housing section 27 and closed to seal the roll 31 within the housing section 27.

A housing section 37 has a cover 39 positioned on hinge 47 so that it can be opened to permit insertion of a dry tissue or moist roll of tissue 41 within housing section 37 or closed to permit sealing the roll within housing section 37. Sealing of the housing sections can be effected in the manner described above with reference to dispenser 10. When dry tissue is stored in housing section 37, cover 39 need not be utilized. However, it must be utilized when moist tissue is stored in housing section 37.

The back surfaces 43 and 45 of housing sections 27 and 37 respectively contact wall 23 so that rotation of dispenser 25 is prevented during use in dispensing dry or moist tissue from dispenser 25.

Figure 10:
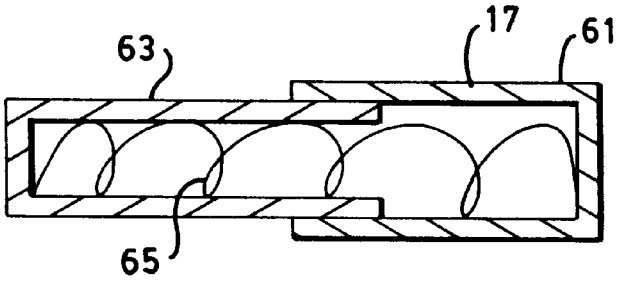
FIG. 10 is a cross-sectional view of a conventional spindle construction presently used for toilet tissue.

Referring to FIG. 10, a conventional support spindle 17 for toilet tissue is shown. Two cylinders 61 and 63 are slideably mounted to each other. A spring 65 is positioned within cylinders 61 and 63. The spring 17 permits the cylinders 61 and 63 to slide with respect to each other and serves to retain the cylinders 61 and 63 with arms 22 (FIG. 2).

Figure 11:
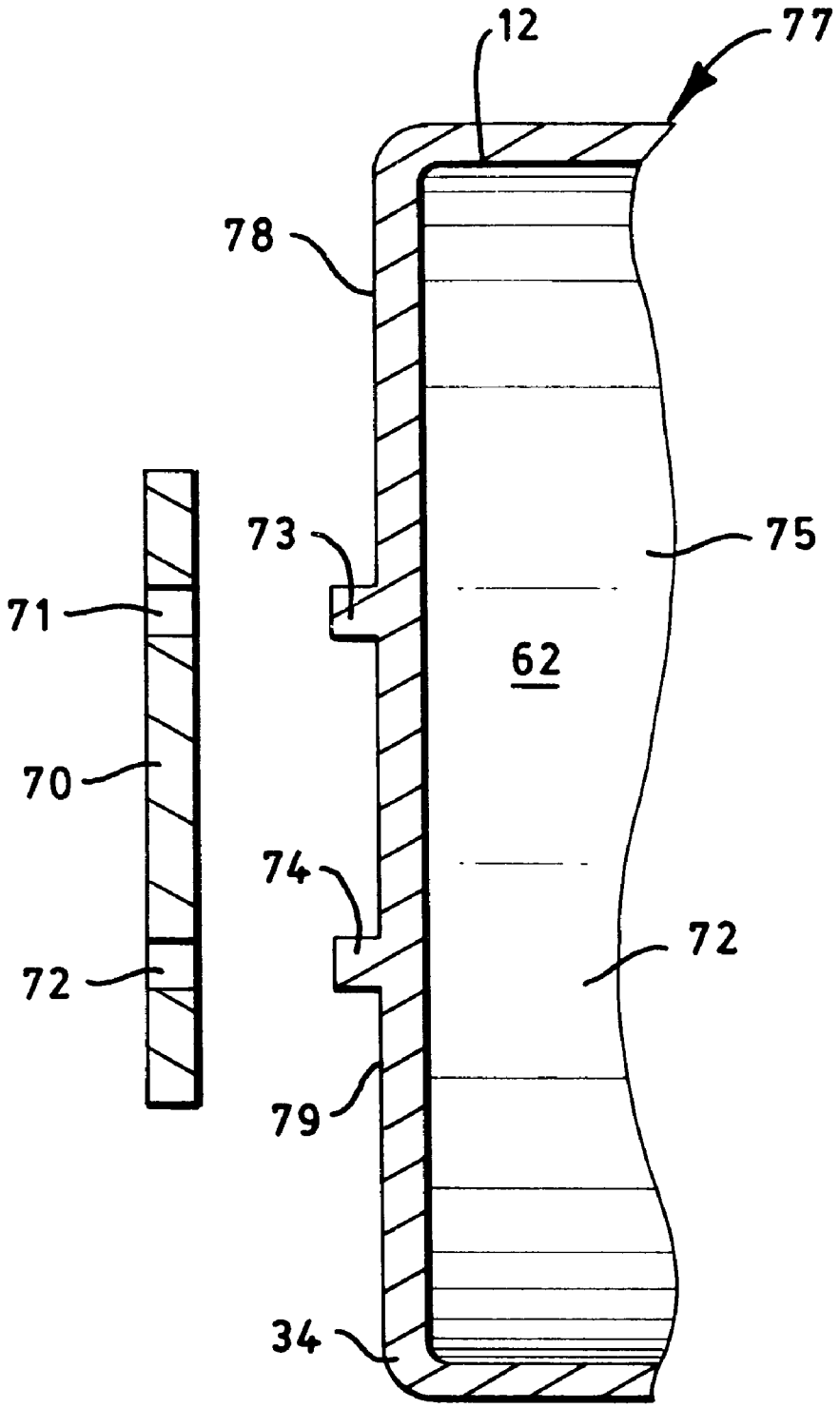
FIG. 11 illustrates an optional sealing means for sealing a dispenser construction of this invention.

Referring to FIG. 11, an optional sealing means is shown for sealing a cover 34 to housing section 12. An arm 70 includes two holes 71 in 72 which mate respectively with posts 73 and 74. The posts 73 and 74 are spaced apart a distance such that when the arm 70 is positioned over the posts 73 and 74, the cover 34 and wall 75 are tightly contacted with each other to form an effective seal between the interior of the housing section 12 and the surrounding atmosphere.

Figure 12:
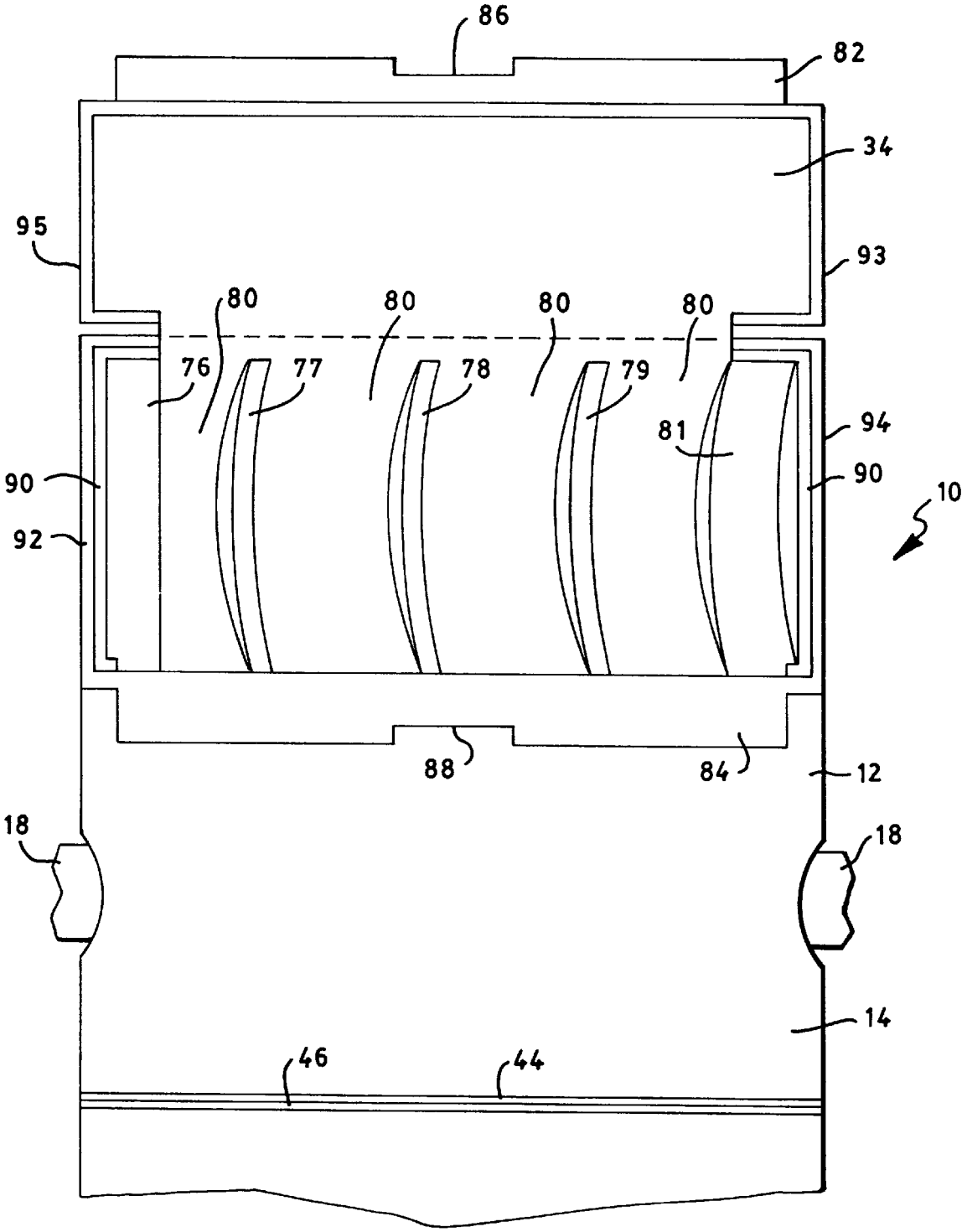
FIG. 12 illustrates an optional inner surface configuration of a dispenser of this invention.

Referring to FIG. 12, the interior surface of the housing section 12 can be modified to reduce the frictional forces exerted on the interior surface of the dispenser when a roll of moist tissue housed therein is unrolled during dispensing. The raised flanges 76, 77, 78, 79 and 81 which extend about substantially the portion of the interior surface that contacts the moist tissue so that the moist tissue contacts only the area presented by the flanges 76, 77, 78, 79 and 81 rather than entire surface 80. The effect of this construction is to reduce the frictional forces on the moist tissue being dispensed. The flanges 82 and 84 can be provided with slots 86 and 88 so that at least a portion of the tissue positioned between the flanges 82 and 84 are visible to the user and can be accessed by the user with one hand. The portion of the housing section 12 which cooperates with the cover 34 includes extensions 90 which are raised above the flanges 92 and 94 which contact the flanges 93 and 95 while the extension 90 fit within the cover 34 when the cover 34 is closed. The cover 34 is secured to hinge 33 so that it is pivotable about hinge 33.

Figure 13:
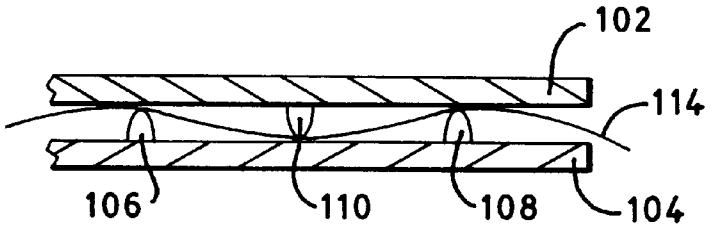
FIG. 13 is a partial cross-sectional view of the slit opening of the dispenser of FIG. 14 taken along line 10—10.
Figure 14:
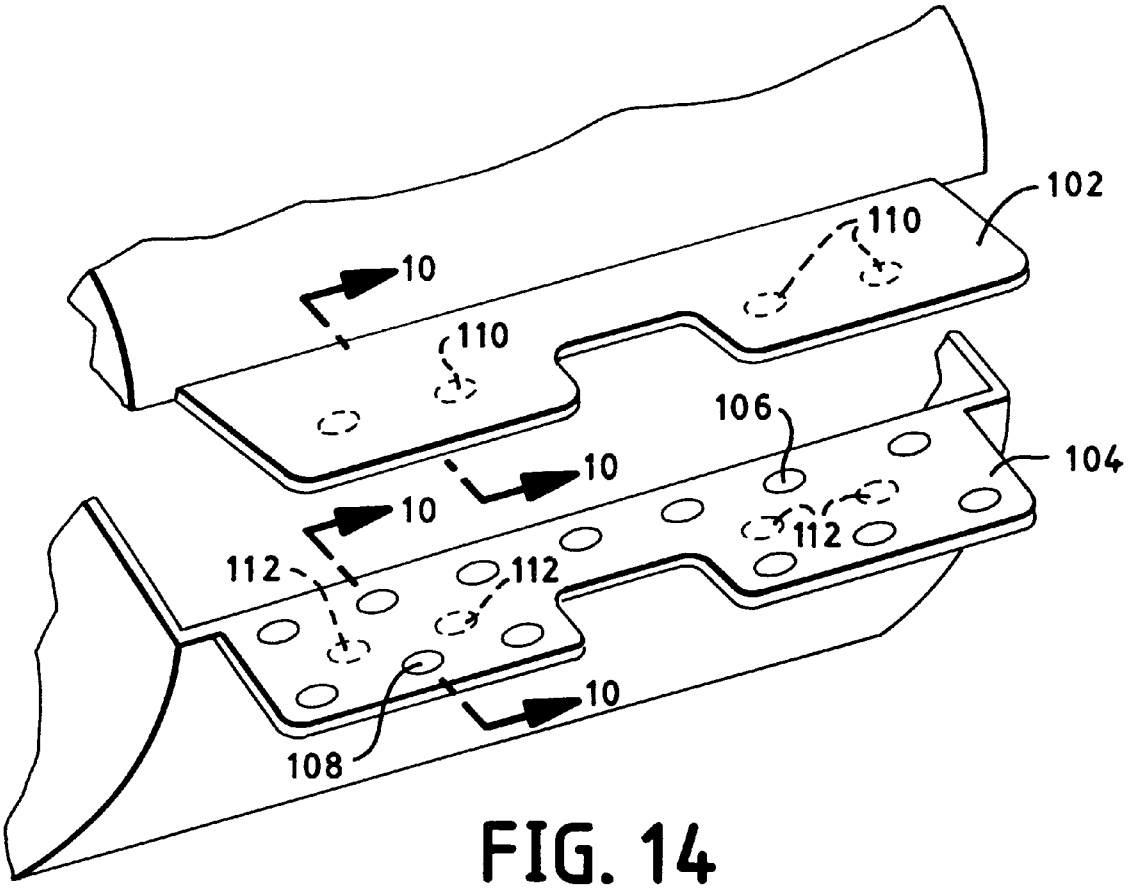
FIG. 14 is a partial isometric view of the slit opening os a dispenser of this invention.

FIGS. 13 and 14 illustrate alternative means for increasing sealing within the volume positioned between flanges 102 and 104. As shown in FIG. 11, the flange 104 includes two rows of prongs 106 and 108 having blunted end surfaces so that they do not rip the tissue positioned between the flanges 102 and 104. The top flange 102 includes one row of prongs 110 which, when the flanges are positioned adjacent each other, are in the position shown as row 112. The prongs 108, 110 and 106 present a tortuous path for any vapor within the dispenser and, together with the moist tissue 114 provide adequate seal to prevent substantial evaporation of vapor from a dispenser.

Figure 15:
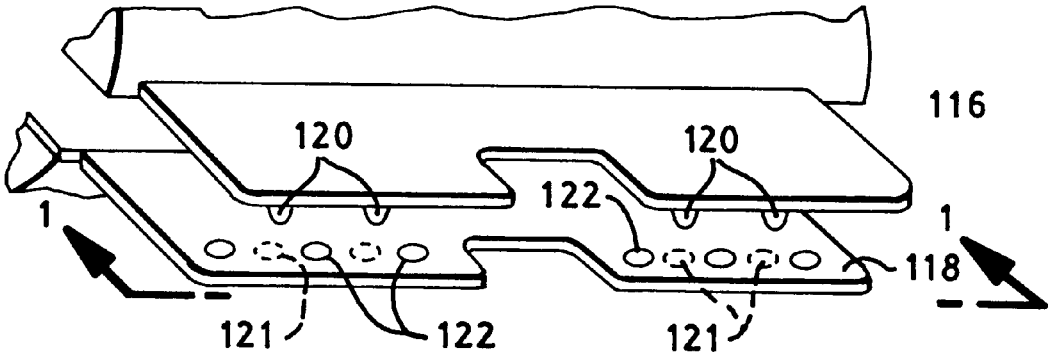
FIG. 15 is a partial isometric view of an alternative slit construction of the dispenser of this invention.
Figure 16:
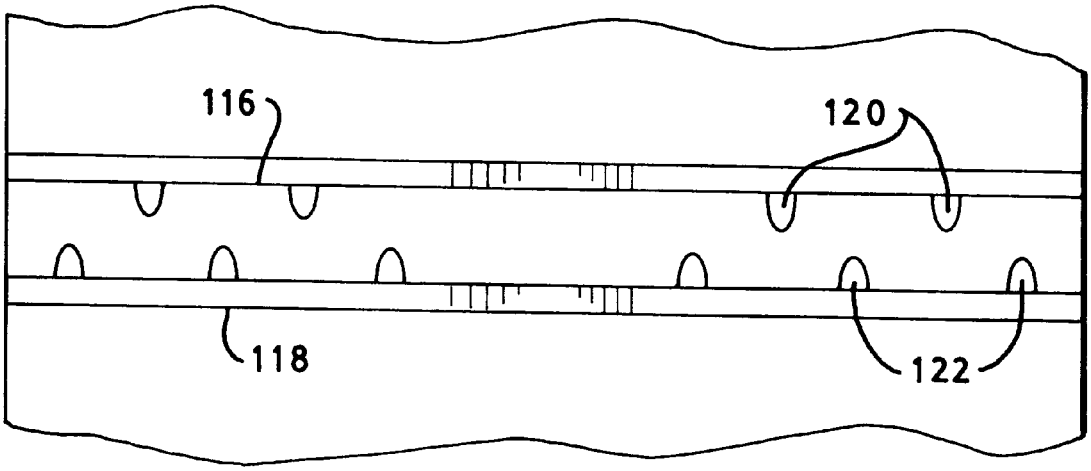
FIG. 16 is a front view taken along line 13—13 of the dispenser of FIG. 15.

Referring to FIGS. 15 and 16, an alternative arrangement of prongs positioned on flanges 116 in 118 is shown. The prongs 120 are positioned at the positions 121 when the flanges 116 and 118 are closed so that they and adjacent prongs 122 form a new row of prongs having the prongs off set in the manner shown in FIG. 11.

Figure 17:
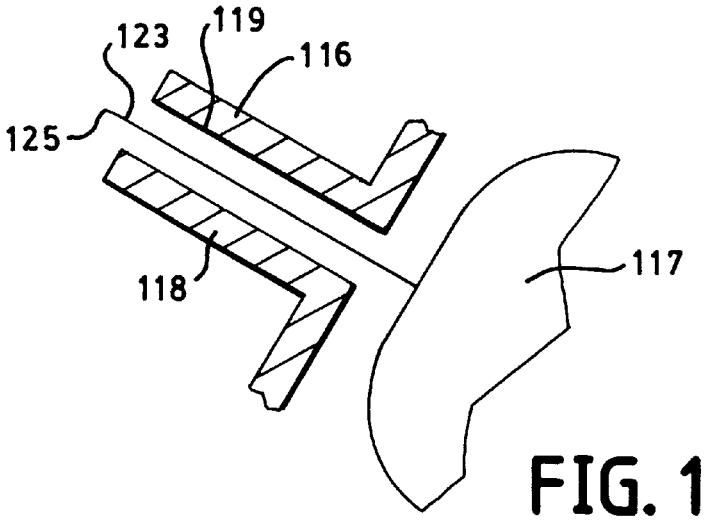
FIG. 17 is a partial cross sectional view illustrating an alternative slit construction of the dispenser of this invention.

Referring to FIG. 17, a slit of the dispenser of this invention can be formed on flanges 116 and 118 to which are attached a brush structure 119 formed of fibers which extend across the width of a tissue 123 being dispensed. The brush structure 119 prevents the leading edge 125 of the tissue 123 from being pulled back onto the roll of tissue 117 so that the edge 125 remains exposed. The brush 119 also provides an additional vapor seal.

Figure 18:
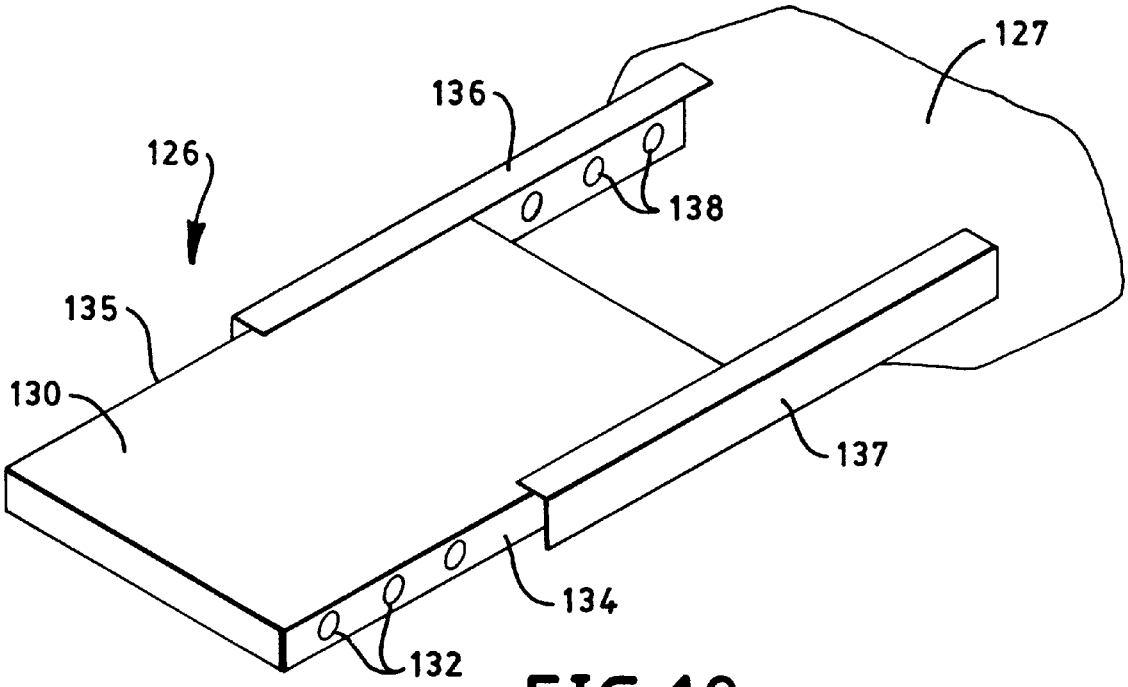
FIG. 18 is a perspective view of an adjustable structure for effecting contact of the apparatus of this invention to a fixed substrate.

Referring to FIG. 18, the apparatus 126 can be positioned on surfaces 127 and 128 (FIG. 1). Apparatus 29 functions to effect contact of the apparatus of FIG. 1 with the wall 29 regardless of the distance between wall 26 and spindle 18. A plate 130 having prongs 132 on surfaces 134 and 135 is slideably mounted in rails 136 and 147 which have depressions 138. The prongs 132 and depressions 138 are sized so that the plate can be hand operated to position the plate 130 which contacts the wall 29 into a desired position. Alternatively, the depressions 138 can be positioned on the plate 130 and the mating prongs can be positioned on rails 136 and 137.

While the dispenser construction of this invention has been described with reference to a unitary construction, it is to be understood that it can be formed from two housing sections which are joined together to form a space through which a spindle can be passed. The two housing sections can be joined together by any conventional means such as by being molded to be shaped to allow joining by a snap fit.

I claim:

1. A dispenser for housing two rolls of tissue which comprises:

a first housing section having a first interior shaped to store a roll of moist tissue and having a cover which, when open, permits placement of a roll of moist tissue within said first housing section and, when closed, seals the interior of said first housing section from surrounding atmosphere and forms a slot to permit dispensing of said moist tissue from said first housing section, a second housing section having a second interior shaped to store a roll of tissue, said first housing section and said second housing section being joined together while being spaced apart from each other thereby to form a slot, said slot being shaped to permit a spindle means for supporting said housing sections to be inserted into said slot.

2. The dispenser of claim 1 wherein said second housing section includes a cover which, when open, permits placement of a roll of tissue within said second housing section and which, when closed, seals the interior of said second housing section from surrounding atmosphere and forms a slot to permit dispensing of said tissue from said roll of tissue from said second housing section.

3. The dispenser of claim 2 wherein said first interior and said second interior include at least one raised surface for supporting a roll of tissue.

4. The dispenser of claim 1 wherein said slot includes a lip on a surface of said slot which permits passage of a spindle through said lip when said dispenser is moved relative to said spindle and prevents passage of said spindle through said lip when said dispenser is stationary.

5. The dispenser of any one of claims 1, 2 or 4 which is formed of a unitary construction.

6. The dispenser of claim 1 wherein said first interior includes at least one raised surface for supporting a roll of tissue.

7. The dispenser of claim 1 wherein at least one of said first housing section and said second housing section includes adjustable means for contacting said dispenser to a fixed substrate.

8. A dispenser for housing two rolls of tissue which comprises:

a first housing section having a first interior shaped to store a roll of moist tissue having a cover which, when open, permits placement of a roll of moist tissue within said first housing section and, when closed, seals the interior of said first housing section from surrounding atmosphere and forms a slot to permit dispensing of said moist tissue from said fist housing section, a second housing section having a second interior shaped to store a roll of tissue, said first housing section and said second housing section being joined together by a joining section, said joining section having a space extending the width of said joining sections, said space being shaped to permit a spindle means for supporting said housing sections to be passed through said width.

9. The dispenser of claim 8 wherein said second housing section includes a cover which, when open, permits placement of a roll of tissue within said second housing section and which, when closed, seals the interior of said second housing section from surrounding atmosphere and forms a slot to permit dispensing of said tissue from said roll of tissue from said second housing section.

10. The dispenser of claim 9 wherein said first interior and said second interior include at least one raised surface for supporting a roll of tissue.

11. The dispenser of any one of claims 8 or 9 which is formed of a unitary construction.

12. The dispenser of claim 8 wherein said first interior includes at least one raised surface for supporting a roll of tissue.

13. The dispenser of claim 8 wherein at least one of said first housing section and said second housing section includes adjustable means for contacting said dispenser to a fixed substrate.

* * * * *